United States Patent [19]

Forster et al.

[11] Patent Number: 4,775,059

[45] Date of Patent: Oct. 4, 1988

[54] SUPPORT CONSTRUCTION FOR A PIVOTAL JOINT

[75] Inventors: Hilmar Forster, Wolfenbüttel; Joachim Kreher, Brunswick, both of Fed. Rep. of Germany

[73] Assignee: Scharfenbergkupplung GmbH, Fed. Rep. of Germany

[21] Appl. No.: 849,883

[22] Filed: Apr. 9, 1986

[30] Foreign Application Priority Data

Apr. 13, 1985 [DE] Fed. Rep. of Germany ..... 3513294

[51] Int. Cl.[4] ..... B61G 9/04

[52] U.S. Cl. ..... 213/1 A; 213/9

[58] Field of Search ..... 213/1 A, 9, 40 R, 78, 213/220; 188/371, 374

[56] References Cited

U.S. PATENT DOCUMENTS

| | | | |
|---|---|---|---|
| 3,149,731 | 9/1964 | Dunlop | 213/9 |
| 3,887,047 | 6/1975 | Harnish et al. | 188/371 X |
| 4,054,314 | 10/1977 | Yamanaka | 188/374 X |
| 4,059,304 | 11/1977 | Yamanaka | 188/374 X |
| 4,078,636 | 3/1978 | Yamanaka | 188/374 |
| 4,375,857 | 3/1983 | Gunther et al. | 213/220 X |

FOREIGN PATENT DOCUMENTS

| | | | |
|---|---|---|---|
| 1124536 | 3/1962 | Fed. Rep. of Germany | 213/1 A |
| 1180394 | 10/1964 | Fed. Rep. of Germany | 213/220 |
| 2140271 | 6/1972 | Fed. Rep. of Germany | 213/9 |
| 992851 | 5/1965 | United Kingdom | 213/220 |

*Primary Examiner*—Peter A. Aschenbrenner
*Assistant Examiner*—Thomas A. Rendos
*Attorney, Agent, or Firm*—McGlew & Tuttle

[57] ABSTRACT

To avoid, after excessive shocks in the underframe in the forestructure and at the coupling of a traction/-thrust pivoted joint or device of a vehicle, deformations of a central buffer coupling at the underframe of the vehicle is proposed. Arranged between the carrier plate for the support of the traction/thrust device and the coupling uptake at the underframe in each instance is a shock absorber which in case of excessive shocks becomes deformed elastically and/or plastically and permits a deformation path preset for the force acting at the time.

12 Claims, 1 Drawing Sheet

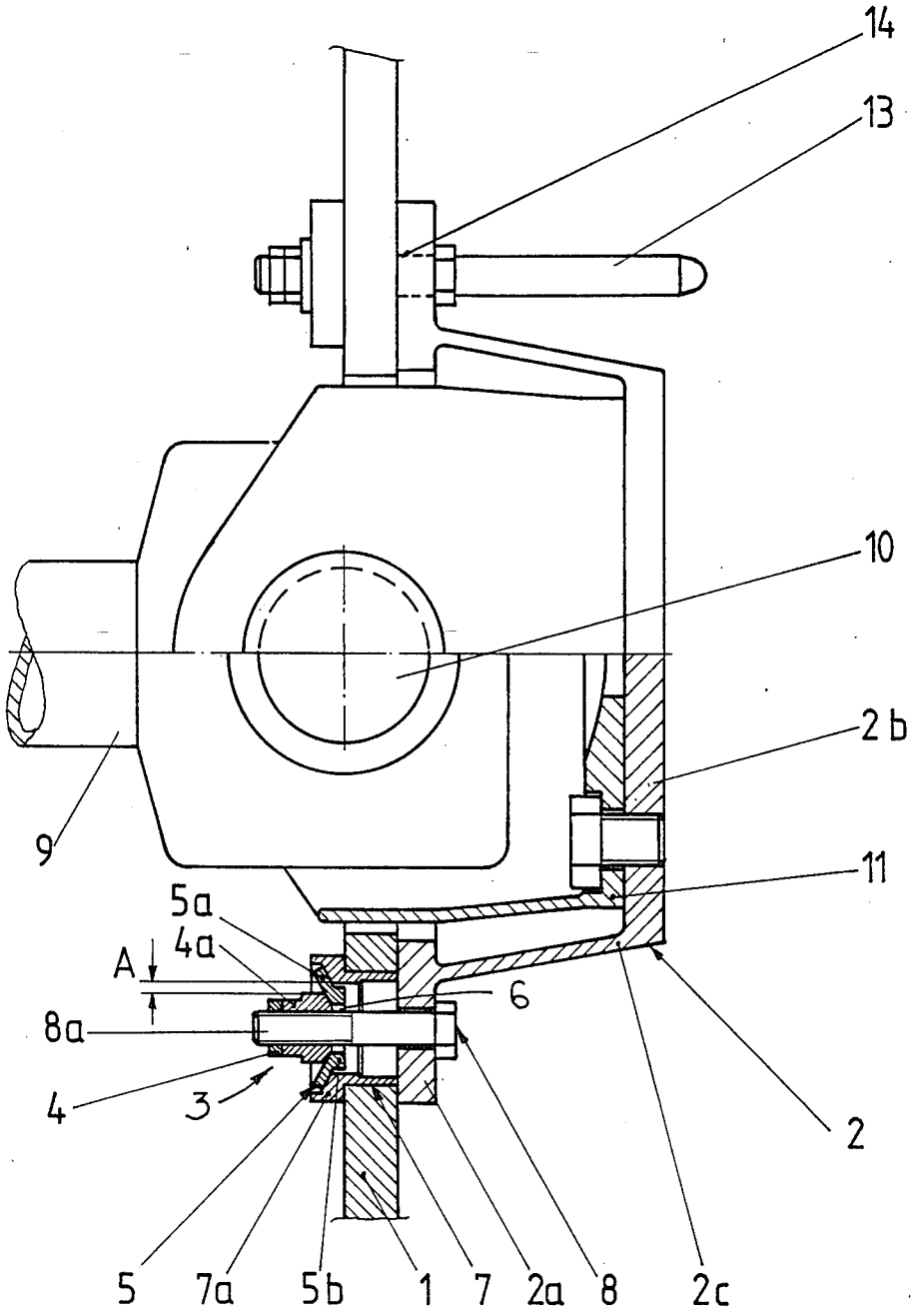
14
13
10
2b
9
11
5a
4a
A
6
8a
4
3
2
5
7a
5b
1
7
2a
8
2c

SUPPORT CONSTRUCTION FOR A PIVOTAL JOINT

FIELD AND BACKGROUND OF THE INVENTION

This invention relates in general to vehicle couplings and in particular to a new and useful support of a traction/thrust device of a central buffer coupling and a coupling uptake.

A support of a traction/thrust device of a cenral buffer coupling at the coupling uptake, in particular, the uptake perpendicular to the longitudinal axis of the vehicle, includes detachable connectors, aligned with the longitudinal axis of the vehicle, between the support and the coupling uptake.

To absorb the energy produced in a vehicle such as a train car at coupling speed and at traction force differences, springs are in general used at the coupling. For the reduction of higher thrust forces energy consumption elements are employed which operate either destructively or regeneratively. Such shock absorbers are known for example from German Pat. No. 15 30 223, German Pat. No. 19 12 049 or from German Pat. No. 19 47 819. A customary attachment of the traction/thrust device at the head beam of the vehicle frame with screws is shown in German Pat. No. 27 41 739. This rigid attachment of the traction/thrust device at the head or coupling uptake proves disadvantageous when still higher impact forces act on the traction/thrust device, after the energy absorption capacity of the shock absorber is exhausted. Deformations occur at the couplings, in the underframe, in the region of the coupling articulation, as well as in the front region of the fore-structure. Because deformations in the coupling and in the underframe require costly repairs, it is proposed to reduce the thrust energy by employing additional energy absorption elements in the form of destructive or regenerative elements or respectively by controlled deformation in the front region of the fore-structure, and to place them in a cost-effficient location. This presupposes that the required path for the energy absorption is accommodated either additionally in the drawbar or at the attachment of the traction/thrust device at the underframe.

Summary and Objects of the Invention

Accordingly it is an object of the invention to provide an improved support for a pivotal joint of a buffer coupling which includes a carrier plate having side web portions with a radially extending flange supported on a coupling uptake by means of shock absorber connections which part includes a part deforms elastically and/or plastically and permits a deformation path which is preset for any forces with act.

A further object of the invention is to provide a support for a coupling of a vehicle which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only FIGURE shows a support according to the invention in top view and in partial section.

DESCRIPTION OF THE PREFERRED EMBODIMENT

Referring to the drawing in particular the invention embodied therein comprises a shock absorber support generally designated 3 for a carrier plate 2 which has a backwall **2*b* for supporting a traction/thrust device or pivotal joint 9. The carrier plate is part of a construction which includes side webs or web 2*c* having an outer end with a radial flange 2*a* which provides a support connection to a coupling uptake 1. In accordance with the invention a shock absorber for mounting the assembly to the coupling uptake 1 includes a shock absorber generally designated 3 which has an elastically deformable or plastically deformable part such as a safety plate 5** which upon excessive impacts deforms either elastically or plastically and permits a deformation path which is preset for any respective force which acts on the assembly.

Relative to the coupling intake 1 a carrier plate 2 is arranged offset toward the vehicle center, it being braced by flanges **2*a* against the side of the coupling uptake 1 turned toward the carrier plate 2 and the degree of offset is determined by the length of the web 2*c*. The carrier plate 2 is fastened at the coupling uptake 1 with interposition of one shock absorber 3 per detachable connection. The shock absorber 3** permits, in case of excessive shock, a deformation path preset for the force acting at the time with plastic deformation of its flexible parts.

The shock absorber 3 according to FIG. 1 is designed as follows: Between an abutment **4*a*, secured by a nut 4, and the side of the coupling uptake 1 pointing toward the vehicle end, a safety plate 5 is arranged which braces itself by its collar 5*a* protruding over a bore 6. The bore 6 is either cut directly into the coupling uptake 1, or it is determined by the inside dimension of a bushing 7 introduced into the coupling uptake 1, the bushing bracing itself by a collar portion 7*a* against the side of the coupling uptake 1 pointing toward the vehicle end. The bore 6 surrounds the shank 8*a* of a screw 8 at a predetermined distance. The distance A between the outer contour of abutment 4*a* and the inside dimension of bore 6 is either greater than the thickness of the safety plate 5 or it is smaller than or equal to the thickness of the safety plate 5. The safety plate 5 is either flat or conical and with or without an internal sleevelike shoulder 5*b*. The plate may be either convex or concave and preferably concentric around the screw 8 and applies against the abutment of the coupling uptake 1. Also accordingly formed alike and either flat or conical is the sleeve 7 having a collar 7*a*. In its sleeve-like shoulder 5*b* which protrudes into bore 6, and in its collar 5*a*, the safety plate 5** may have either the same or a different material thickness.

The traction/thrust device 9 braces itself on the side of the base plate **2*b* pointing toward the vehicle end. The pivot point of a pivot pin 10 of a bearing block 11 of the coupling articulation is thus fixable selectively before, behind, or at the level of the front edge of the coupling uptake 1, preferably by varying the length of the webs 2*c* of the carrier plate 2**, by thickness variation of the base plate 2*b*, or by additional spacers (not shown).

In other forms of realization of the invention the carrier plate 2 is formed as part of the bearing block 11 of the coupling articulation.

At the coupling uptake 1, or, selectively, at the carrier plate 2, there is fastened in the longitudinal direction of the vehicle at least one guide bar 13 which protrudes into a respective guide 14 in the carrier plate 2 or in the coupling uptake 1.

The thrust forces acting normally on the coupling head are absorbed by the traction/thrust device (not shown). To reduce excessive shocks, shock absorbers of known design are arranged as energy consuming elements within the traction/thrust device. At still higher impact forces the safety plate 5 of the shock absorber 3 yields, and at the desired defined dynamic action, lets the inner abutment consisting of nut 4, abutment 4*a*, safety plate 5 and screws 8 slip through. The outer abutment is formed by the bore 6. Depending on the spacing of the two abutments, given by the distance A between the outer contour of abutment 4*a* and the inside dimension of bore 6 and the thickness of the safety plate 5, the safety plate 5 is plastically deformed accordingly and may possibly be sheared off. Shearing off is to be expected at a very narrow spacing in relation to the thickness of the safety plate 5. The carrier plate 2 with the traction/thrust device 9 secured thereto is displaced preferably in the direction preset by the guide bar 13 and guide 14 in a controlled manner.

Besides the form of realization for the shock absorber 3 illustrated in this example of the invention, forms are conceivable where the shock absorber 3, under elastic and/or plastic deformation of its flexible parts, permits a deformation path preset for the forces acting at the time.

While a specific embodiment of the invention has been shown and described in detail to illustrate the application of the principles of the invention, it will be understood that the invention may be embodied otherwise without departing from such principles.

What is claimed is:

1. A traction/thrust support of a central buffer coupling for vehicles having a coupling uptake secured to a carrier plate flange portion so as to be arranged substantially perpendicular to the longitudinal axis of the vehicle, comprising: at least one detachable connection substantially aligned with the longitudinal axis of the vehicle between the carrier plate and the coupling uptake, the carrier plate being arranged offset relative to said coupling uptake toward a center of the vehicle; a shock absorber positioned between the flange portion of the carrier plate and the coupling uptake, the shock absorber including an elastically or plastically deformable member permitting a deformation path preset for the respective force acting thereon; and, at least one guide bar positioned at said coupling uptake and adapted to push the carrier plate into a preset direction as a deformation path is consumed.

2. A support according to claim 1, wherein said deformable member comprises a safety plate having an opening therethrough, a securing bolt extending through said opening and a nut threaded on said securing bolt and bearing against said safety plate, said safety plate bore therethrough being of a larger size than said bolt leaving a space therebetween.

3. A support according to claim 2, wherein said nut includes a projection edge bearing against said safety plate, the coupling uptake having an opening therethrough and including a bushing installed in the opening of said coupling plate having an outer flange engaged against said safety plate.

4. A support according to claim 3, wherein said bushing has a bore large enough for passage of the bolt therethrough, said safety plate comprises a collar having a obliquely extending wall portion extending radially between said nut and said bushing abutment and having a bore therethrough large enough to be spaced from the periphery of said bolts.

5. A support according to claim 1, wherein said coupling uptake includes a bore therethrough, a bushing extending through said bore being part of said shock absorber, a bolt of a much smaller diameter than the interior of said bushing extending through said bushing, a nut threaded onto said bolt in a deformable safety plate disposed between said nut and the bushing.

6. A support according to claim 5, wherein said bushing includes a flange portion bearing on the exterior of said coupling uptake and having an inner surface, said holding plate being engaged against the inner surface of said bushing and including a hub portion and obliquely extending collar portion disposed between said nut and said flange of said bushing.

7. A support according to claim 1, including a coupling uptake member having an opening therethrough, a pivot pin assembly mounted in the opening of said coupling uptake, a carrier plate of disc shaped construction having a backplate portion engaged with said pivot pin assembly and including a flange portion bearing against said coupling uptake around the opening thereof, said shock absorber including an opening disposed in the coupling plate aligned with the flange portion of said carrier plate, a bolt extending through said carrier plate flange portion and to the opening of said coupling uptake, a nut threaded to said bolt and a safety plate disposed between said nut and said carrier plate forming said elastically deformable member.

8. A support according to claim 7, wherein said pivot pin articulation can be selectively arranged on one side of the uptake at a selected projection from a side thereof by varying the length of the side walls of said carrier plate assembly, said carrier plate being formed as a part of a bearing block of the central buffer coupling comprising said pivot pin assembly.

9. A support according to claim 8, wherein said safety plate is a hub portion and a radially extending portion including a bushing of said shock absorber positioned in the opening of said coupling plate and having an outer bushing flange abutting against said radially extending portion of said safety plate, the spacing of the outer radial edge of the safety plate relative to the outer periphery of said nut being greater than the thickness of said safety plate.

10. A support according to claim 9, wherein the spacing of the outer edge of said safety plate relative to the periphery of said nut is greater than the thickness of said safety plate.

11. A support according to claim 1, wherein the spacing of the outer edge of said safety plate from the periphery of said nut is made smaller than the thickness of said safety plate

12. A support of a traction/thrust device for a central buffer coupling for vehicles which have a coupling uptake secured to carrier plate having a flange portion which is securable to the uptake so as to be arranged perpendicular to the longitudinal axis of the vehicle, comprising at least one detachable connection aligned with the longitudinal axis of the vehicle between the carrier plate and the coupling uptake, said carrier plate being arranged offset relative to said coupling uptake toward the center of the vehicle, said traction/thrust device being braced by the flanges of said carrier plate against the side of said coupling uptake, a shock absorber between said flanges and said coupling uptake, which under excessive impacts includes an elastically or plastically deformable member which permits a deformation path preset for the respective force which acts thereon, a coupling uptake member having an opening therethrough, a pivot pin assembly mounted in the opening of said coupling uptake, a carrier plate of disc shaped construction having a backplate portion engaged with said pivot pin assembly and including a flange portion bearing against said coupling uptake around the opening thereof, said shock absorber including an opening disposed in the coupling plate aligned with the flange portion of said carrier plate, a bolt extending through said carrier plate flange portion and to the opening of said coupling uptake, a nut threaded to said bolt and a safety plate disposed between said nut and said carrier plate forming said elastically deformable member, said pivot pin articulation can be selectively arranged on one side of the uptake at a selected projection from a side thereof by varying the length of the side walls of said carrier plate assembly, said carrier plate being formed as a part of a bearing block of the central buffer coupling comprising said pivot pin assembly, at least one guide bar arranged at said coupling uptake pushing the carrier plate into a preset direction as a deformation path is consumed.

* * * * *